US005820068A

United States Patent [19]

Hosomi et al.

[11] Patent Number: 5,820,068

[45] Date of Patent: Oct. 13, 1998

[54] PRINTER WITH PAPER END DETECTION

[75] Inventors: Hiroaki Hosomi; Toru Takami; Akio Nomura; Satoshi Nakajima; Yoshiharu Matsumoto, all of Nagano, Japan

[73] Assignee: Seiko Epson Corporation, Tokyo, Japan

[21] Appl. No.: 811,733

[22] Filed: Mar. 6, 1997

[30] Foreign Application Priority Data

Mar. 6, 1996 [JP] Japan ..... 8-049011

[51] Int. Cl.[6] ..... B65H 16/02; B65H 26/08

[52] U.S. Cl. ..... 242/563; 242/563.2; 242/595

[58] Field of Search ..... 242/563, 563.2, 242/591, 595; 83/649, 949

[56] References Cited

U.S. PATENT DOCUMENTS

| | | | |
|---|---|---|---|
| 4,204,180 | 5/1980 | Usui et al. | 242/563.2 |
| 4,494,706 | 1/1985 | Becherer et al. | 242/591 |
| 5,174,518 | 12/1992 | Hongo et al. | 242/595 |
| 5,566,906 | 10/1996 | Kamada et al. | 242/563 |

FOREIGN PATENT DOCUMENTS 61-3872 2/1986 Japan .

1-14597 4/1989 Japan .

OTHER PUBLICATIONS

Patent Abstract of Published Japanese Patent Application 58116184, published Jul. 11, 1983.

Patent Abstract of Published Japanese Patent Application 59143671, published Aug. 17, 1984.

IBM Technical Disclosure Bulletin, vol. 37, No. 5, May 1994, pp. 195–196.

IBM Technical Disclosure Bulletin, vol. 38, No. 9, Sep. 1995, pp. 129–130.

*Primary Examiner*—John M. Jillions

*Attorney, Agent, or Firm*—Sughrue, Mion, Zinn, Macpeak & Seas, PLLC

[57] ABSTRACT

A printer in which a rolled recording paper is housed in a main unit, the printer includes: a housing unit which houses the recording paper, and which has plural guiding portions which cause the recording paper to be located at a predetermined position as a roll diameter of the recording paper becomes smaller; and paper end detecting unit having a detecting element, for, when the detecting element enters a space in a core portion of the recording paper, detecting that remaining amount of the recording paper is reduced to a fixed level or less, wherein the paper end detecting unit is rotatably attached to the housing unit such that the detecting element corresponds to one of the guiding portions.

6 Claims, 8 Drawing Sheets

PRINTER WITH PAPER END DETECTION

BACKGROUND OF THE INVENTION

The invention relates to a printer such as a receipt printer which is used in a POS (Point-Of-Sale) system, and particularly to a printer comprising paper end detecting means for detecting the remaining amount of rolled recording paper.

As a printer of this kind, conventionally, known is a printer in which printing is conducted on rolled recording paper by a thermal head or the like, and the recording paper is then cut off by a cutter so as to be delivered as, for example, a receipt.

The conventional printer is provided with paper end detecting means for detecting the remaining amount of the recording paper. In known paper end detecting means, when the remaining amount of rolled recording paper is reduced to a fixed level or less, for example, a detecting element enters a space in a core portion of the recording paper so as to cause a detection switch to operate, thereby detecting the small remaining amount of the recording paper (for example, see Japanese Utility Model Publications (Kokoku) Nos. Sho. 61-3872 and Hei. 1-14597).

Usually, a printer of this kind is installed on a flat table which is substantially horizontal. In order to enhance the efficiency of the installation place for business machines, office use and the like, such a printer is sometimes installed on a vertical wall so as to efficiently use the space.

However, the installation of such a printer on a vertical wall produces a problem as discussed below.

In order to facilitate the replacement of recording paper, a printer of this kind is often configured so that the core portion of rolled recording paper is not rotatably supported by a shaft and the recording paper is dropped into a housing unit of the main unit of the printer, whereby the outer periphery of the rolled recording paper is made to directly contact with the bottom of the housing unit.

However, the position where the rolled recording paper is stably placed in the case where the printer is installed on a vertical wall is largely different from that in the case where the printer is horizontally installed. Therefore, there arises a problem in that the paper end detecting means which is configured on the assumption that the printer is horizontally installed cannot correctly detect the remaining amount of the recording paper.

In order to solve the problem, it may be contemplated that such a printer is provided with plural paper end detecting means in accordance with positions where recording paper are stably placed. In this case, however, there arise other problems in that plural detecting means must be disposed in a limited space and hence the structure is complicated, that signals of the detecting means must be processed in a complicated manner, and that the production cost is increased.

SUMMARY OF THE INVENTION

The invention has been-conducted in view of the problems of the conventional printer. It is an object of the invention to provide a printer comprising paper end detecting means which, even when the printer is installed at different angles, can correctly detect the end of rolled recording paper, and which is simple in structure.

According to a first aspect of the invention, there is provided a printer in which rolled recording paper is housed in a main unit, and the printer comprises: a housing unit which houses the recording paper, and which has plural guiding portions which cause the recording paper to be located at a predetermined position as a roll diameter of the recording paper becomes smaller; and paper end detecting means for, when a detecting element enters a space in a core portion of the recording paper, detecting that a remaining amount of the recording paper is reduced to a fixed level or less, the paper end detecting means being rotatably attached to the housing unit so that the detecting element corresponds to one of the guiding portions.

According to a second aspect of the invention, there is provided the printer of the first aspect in which the housing unit has an engaging portion which engages with the paper end detecting means, thereby locating the paper end detecting means to a position corresponding to one of the guiding portions.

According to a third aspect of the invention, there is provided the printer described above in which the paper end detecting means comprises: a detection frame which is rotatably attached to at least one side face of the housing unit through a shaft portion, the side face constituting the housing unit; a detecting lever which has the detecting element and which is movably attached to the detection frame; and manual rotating means for manually rotating the detection frame.

According to a fourth aspect of the invention, there is provided the printer of the third aspect, wherein the manual rotating means is configured by plural projections which are integrated with the detection frame, distances between the projections and the shaft portion being substantially equal to each other.

According to a fifth aspect of the invention, there is provide the printer of the third aspect, wherein the detection frame has an oblong hole through which the shaft portion passes, the oblong hole having a narrow portion at a middle portion, the narrow portion being narrowed to have a width smaller than an outer diameter of the shaft portion.

In the printer of the first aspect, the housing unit has plural guiding portions which cause recording paper to be located at a predetermined position as the roll diameter becomes smaller, and the paper end detecting means which is rotatably attached to the housing unit so that the detecting element corresponds to each of the guiding portions disposed therein. Even when the installation angle of the printer is changed, therefore, the positional relationship between the core portion of the recording paper and the detecting element of the paper end detecting means is always kept constant by setting the guiding portions to the angle, and hence the detected remaining amount is not changed. Since the paper end detector is required only to be rotated, the change operation can be conducted very easily.

In the printer of the second aspect, the engaging portion which engages with the paper end detecting member so as to locate the paper end detecting member to a position corresponding to one of the guiding portions is disposed. Even when the paper end detecting means is moved, therefore, the positional relationship between the core portion of the recording paper and the detecting element of the paper end detecting means is correctly kept constant, and hence the detection quality and the working efficiency are enhanced.

As in the printer of the third aspect, when the manual rotating means for manually rotating the detection frame is disposed, the end user can easily change the detection position without using a jig. Consequently, the posture of the printer can be easily changed in accordance with its use, so that workability is extremely improved.

As in the printer of the fifth aspect, the oblong hole having a narrow portion which is narrowed to have a width smaller than the outer diameter of the shaft portion is disposed in the detection frame. In the case where the paper end detecting means is moved in order to conform to the kind of the core or to set a given remaining amount, therefore, the movement of the paper end detecting means can be checked by means of clicking sensation. This is very effective particularly in the case where the position of the detection frame cannot be visually confirmed.

DETAILED DESCRIPTION OF THE PREFERRED EMBODIMENTS

Hereinafter, a preferred embodiment of the printer of the invention will be described in detail with reference to FIGS. 1 to 11(*b*).

Figure 2:
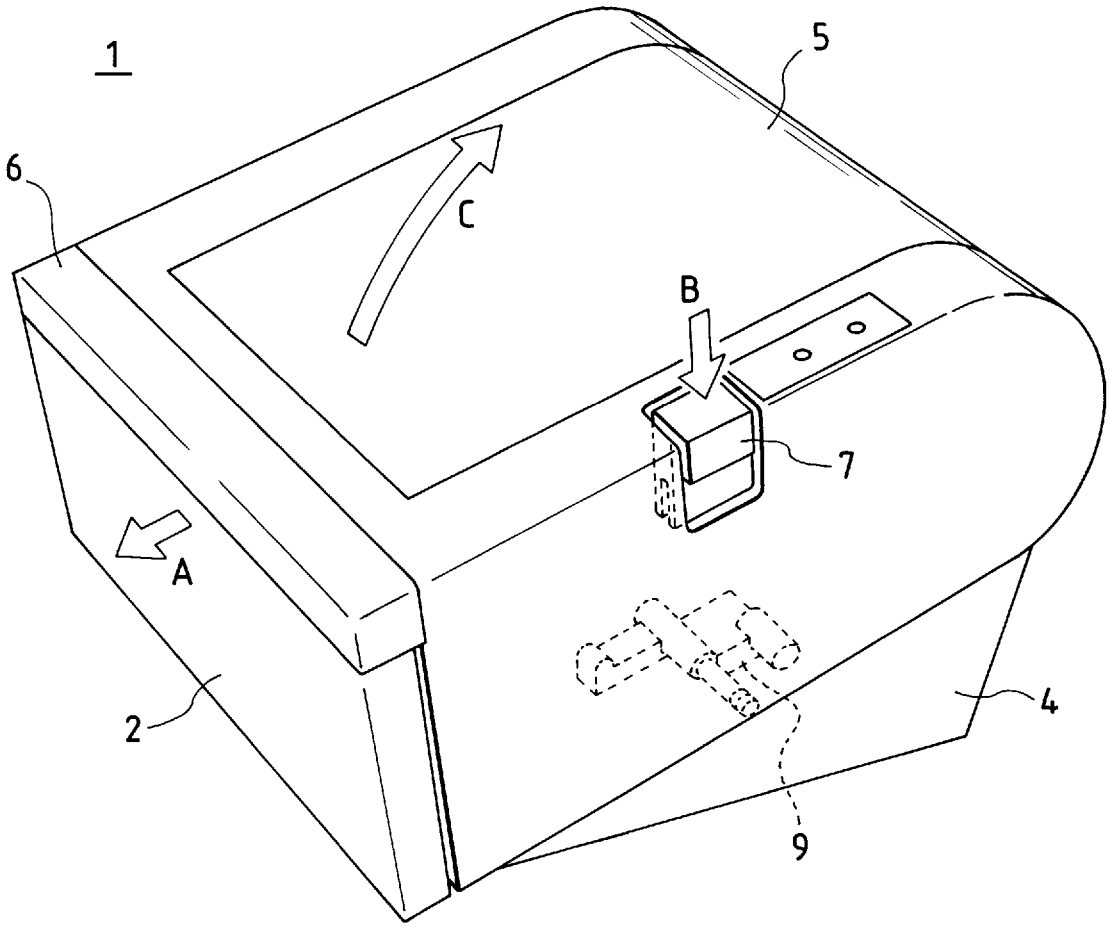
FIG. 2 is a perspective view showing the internal configuration of the embodiment in the state where the cover frame is closed.

FIG. 2 is a perspective view showing the external configuration of an embodiment of the printer of the invention.

The printer 1 of the embodiment is applied to a receipt printer which is used in, for example, a POS system.

Figure 3:
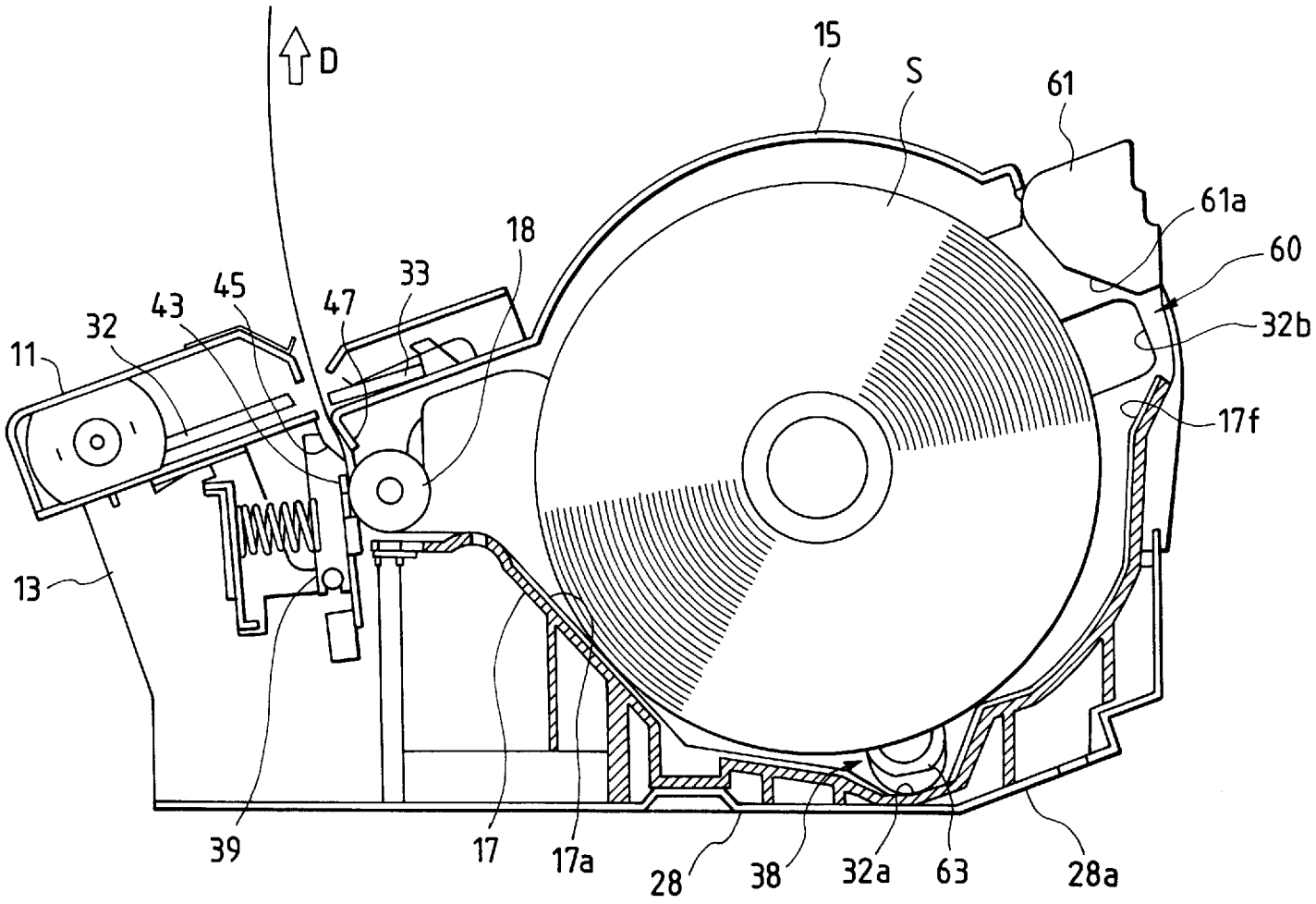
FIG. 3 is a sectional side view showing the internal configuration of the embodiment.

The printer 1 of the embodiment performs recording such as printing on, for example, rolled recording paper S which is one kind of recording media, by using a thermal printing head 39 (see FIG. 3). The printer is mainly configured by a recording unit and a paper-cutter unit which are disposed in the front side, and a roll-paper housing unit which is disposed in the rear side and houses the recording paper S so as to be held therein.

A printer mechanism (see FIG. 2) is covered by a panel 2, an upper cover 5, and the like which are attached to a case main unit 4 made of a resin.

The upper cover 5 is attached to a cover frame 10. When an open button 7 is pressed in the direction of the arrow B, a cover-open lever 9 is rotated in a clockwise direction so as to disengage the locking mechanism, and the upper cover 5 is opened in the direction of the arrow C so that the roll-paper housing unit is exposed.

Figure 1:
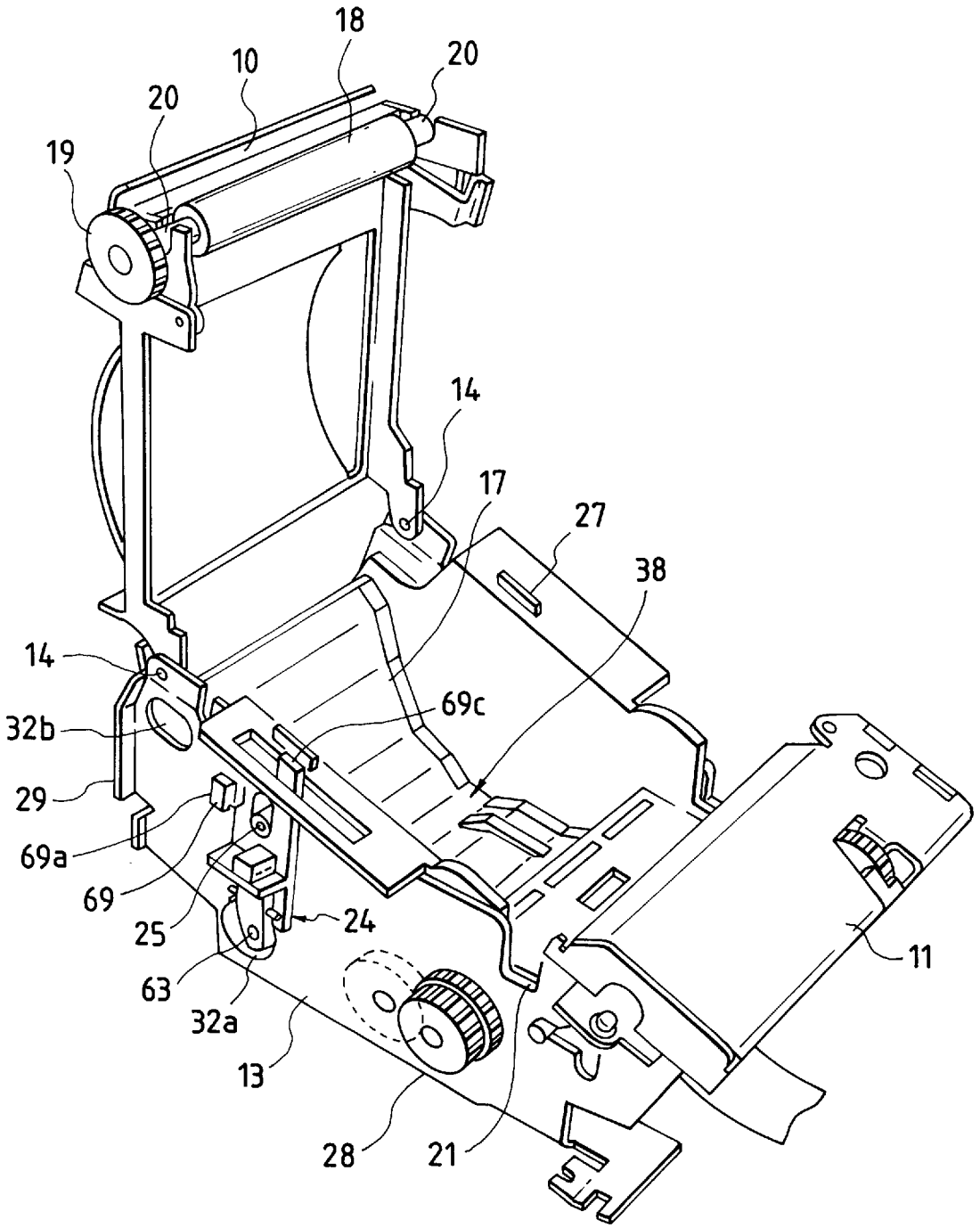
FIG. 1 is a perspective view showing the internal configuration of an embodiment of the printer of the invention in the state where a cover frame is opened.

FIGS. 1 and 2 are perspective views showing the printer mechanism 8 inside the printer 1 of the embodiment. FIG. 1 is an external view as seen from the left side face of the printer mechanism 8 in the state where the cover frame 10 is opened, and FIG. 2 is an external view as seen from the right side face of the printer mechanism 8 in the state where the cover frame 10 is closed.

The printer mechanism 8 comprises the cover frame 10 which can be opened and is disposed on a main unit frame 13 made of a metal or the like, and an automatic cutter unit 11 which houses a movable blade 32 and driving means for the blade.

The cover frame 10 is attached to the main unit frame 13 in such a manner that the cover frame can be swung or opened about the center of support shafts 14 formed in the upper end portions of both sides of the main unit frame 13. The cover frame 10 has an arcuate lid portion 15 so that, when the cover frame 10 is closed, the frame is prevented from contacting with the recording paper S.

As shown in FIG. 1, a roll-paper holder 17 made of a resin is disposed in the inner space which is exposed when the cover frame 10 is opened. Slit grooves 27 which respectively engage with the lateral side face plates of the main unit frame 13 are formed in the roll-paper holder 17. When the slit grooves 27 engage with projections of the lateral side faces of the main unit frame 13, the movement of the roll-paper holder 17 in the direction of its width is restricted and hence the inner space of the recording paper housing unit is kept to have a width adequate for the recording paper S.

A paper end detector 24 for detecting that the remaining amount of the recording paper S is reduced is attached to the left side face of the main unit frame 13 so as to be rotatable about a bolt 25 serving as a support shaft. This configuration is formed in order that, when the installation angle of the printer 1 is to be changed, the paper end detector 24 is located at an optimum position. When the printer is to be installed with downward directing the bottom face 28 of the main unit frame 13 as shown in FIG. 1, for example, a detection lever 63 of the paper end detector 24 is fixed to a position opposing a hole 32*a* which is formed in the main unit frame 13. By contrast, when the printer is to be installed with downward directing the back face 29 of the main unit frame 13, the detection lever 63 is fixed to a position opposing a hole 32*b*.

FIG. 3 is a sectional side view of the printer mechanism 8 and shows the state where the recording paper S is held by the roll-paper holder 17 and the paper is fed. In FIG. 3, the roll of the recording paper S has a large diameter or the outer diameter in the initial state of the use is large. As the paper feed advances and the outer diameter of the recording paper S is gradually reduced, the recording paper S drops into a guiding portion 38. Then, the paper end detector 24 detects that the outer diameter of the recording paper S has a small value. This will be described later in more detail.

The recording paper S is interposed between a platen 18 and the printing head 39. When the platen 18 is rotated, the paper is fed by means of a friction force produced between the paper and the platen.

The recording paper S which has passed over the thermal printing head 39 passes through a gap between the movable blade 32 and a stationary blade 33 and is then discharged in the direction of the arrow D.

An inclined portion 28*a* is formed in the rear side of the bottom face 28 of the main unit frame 13, so as to allow the printer 1 to be installed while being slightly tilted. A guiding portion 60 is disposed in the rear portion of the main unit frame 13. The guiding portion 60 is used for holding the recording paper S when the printer 1 is installed with downward directing the back face 29 of the main unit frame 13.

In the above, the basic configuration of the whole of the printer 1 of the embodiment has been briefly described. Next, the paper end detector 24 which is characteristic of the invention will be described in more detail with reference to FIGS. 4 to 11.

Figure 4:
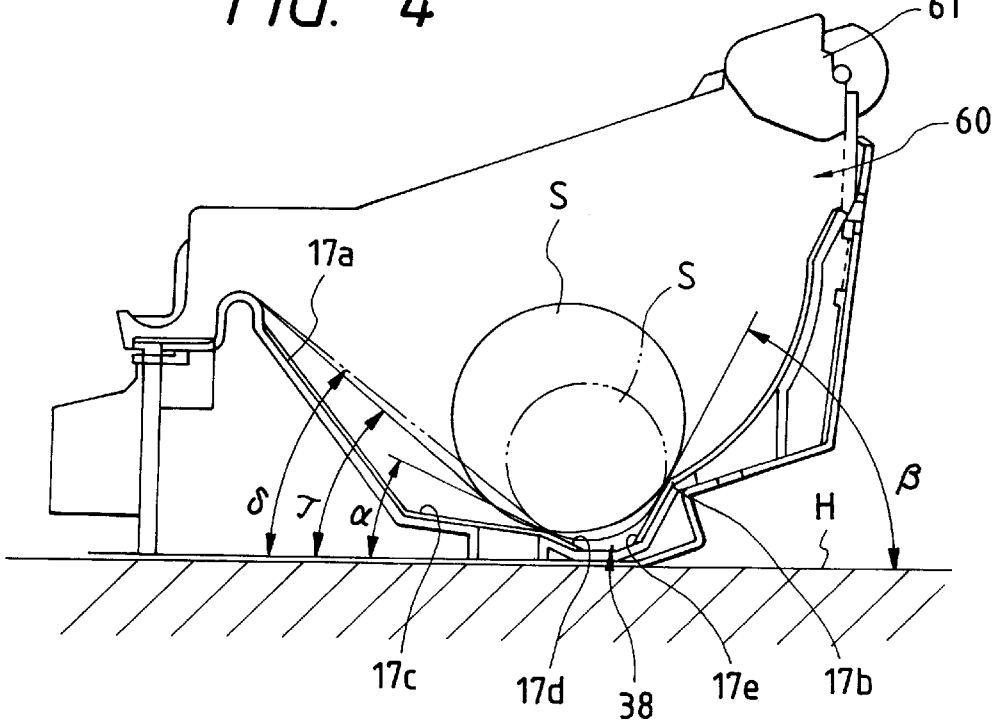
FIG. 4 is a diagram illustrating a stable position in the state where recording paper has a small diameter in the embodiment.

FIG. 4 is a diagram illustrating a stable position in the state where the recording paper S has a small diameter, and shows the case where the printer 1 is installed on a horizontal face H with downward directing the bottom face 28 of the main unit frame 13.

As described above, in the state where the recording paper S has a large diameter, the recording paper S is supported by a supporting face 17*a* formed in the front side of the roll-paper holder 17, and a bent portion 17*b* formed in the rear side of the roll-paper holder 17. When the paper feed advances and the diameter of the recording paper S becomes small, the recording paper S is supported by a supporting face 17*c* and the bent portion 17*b* as shown in FIG. 4. The supporting face 17*c* is formed more rearward than the supporting face 17*a*, so as to form an angle with respect to the horizontal surface which is smaller than that formed by the supporting face 17*a*.

When the paper feed further advances and the diameter of the recording paper S becomes smaller, the recording paper S drops into the guiding portion 38, and is supported thereby. The guiding portion 38 is configured by supporting faces 17*d* and 17*e* which are directed so as to oppose each other. In this case, the supporting face 17*d* is formed more rearward than the supporting face 17*c*, and the supporting face 17*e* is formed so as to be continuous with the bent portion 17*b*. These supporting faces are projected from the respective surrounding faces in a substantially rib-like form, so as to support the recording paper S by a small contact area.

In the embodiment, as shown in FIG. 4, the angle a of the supporting face 17*d* with respect to the horizontal face H is smaller than the angle β of the supporting face 17*e* with respect to the horizontal face H (for example, $\alpha=25°$ and $\beta=65°$).

The angle α of the supporting face 17*d* with respect to the horizontal face H is larger than the angle of the supporting face 17*c* with respect to the horizontal face H. As a result, also the angle of the recording paper S which is pulled out becomes smaller as the diameter of the recording paper S becomes smaller ($\delta<\gamma$).

Figure 5:
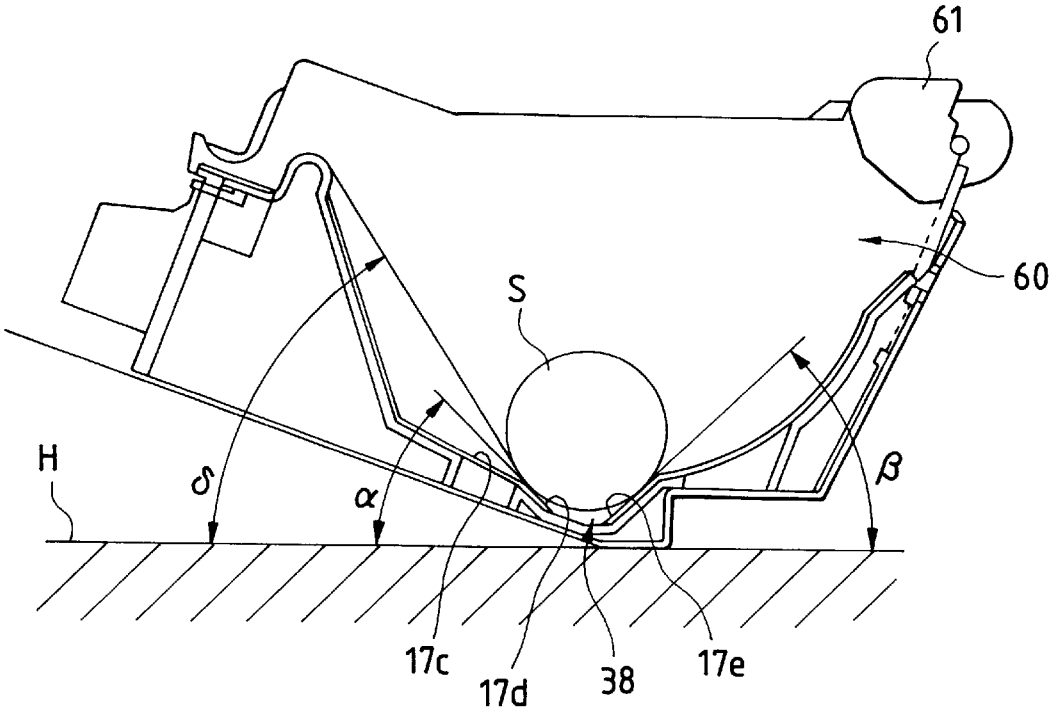
FIG. 5 is a diagram illustrating a stable position in the case where a printer is installed on a horizontal face with downward directing an inclined portion of the bottom face of a main unit frame in the embodiment.

FIG. 5 shows a stable position of the recording paper S in the case where the printer 1 is installed on the horizontal face H with downward directing the inclined portion 28*a* of the bottom face 28 of the main unit frame 13.

Also in this case, as shown in FIG. 5, when the diameter of the recording paper S becomes small, the recording paper S is held by the supporting faces 17*d* and 17*e* of the guiding portion 38.

In the embodiment, the inclined portion 28*a* is inclined by 20° with respect to the bottom face 28 so that, when the printer 1 is installed, the upper cover 5 is horizontal. As a result, in this case, $\alpha=\beta=45°$, and the angle δ of the recording paper S which is pulled out is 59°.

Figure 6:
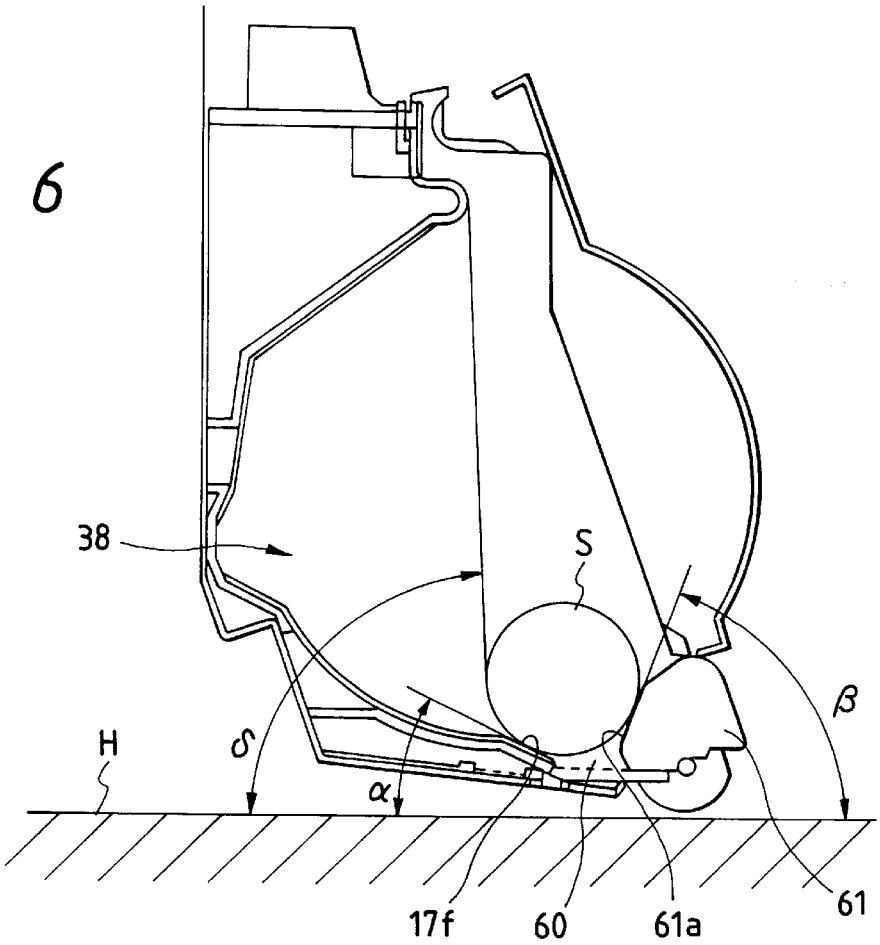
FIG. 6 is a diagram illustrating a stable position in the case where the printer is installed with downward directing the back face of the main unit frame in the embodiment.

FIG. 6 shows a stable position of the recording paper S in the case where the printer 1 is installed with downward directing the back face 29 of the main unit frame 13, such as the case where the printer 1 is installed on a vertical wall.

In this case, as shown in FIG. 6, when the diameter of the recording paper S becomes small, the recording paper S is held by the guiding portion 60 disposed in the rear end portion of the main unit frame 13. The guiding portion 60 is configured by a supporting face 17*f* which is formed in the rear end portion of the roll-paper holder 17, and a supporting face 61*a*. A supporting portion 61 on which the supporting face 61*a* is formed is configured separately from the roll-paper holder 17, and then fixed to the roll-paper holder 17.

In the embodiment, in the same manner as the case shown in FIG. 4 where the printer 1 is installed on the horizontal face H, the angle β of the supporting face 61*a* of the supporting portion 61 with respect to the horizontal face H is larger than the angle α of the supporting face 17*f* with respect to the horizontal face H. In this case, for example, the supporting face is configured so that $\alpha=26°$ and $\beta=64°$, and the angle δ of the recording paper S which is pulled out is 87°.

Figure 7:
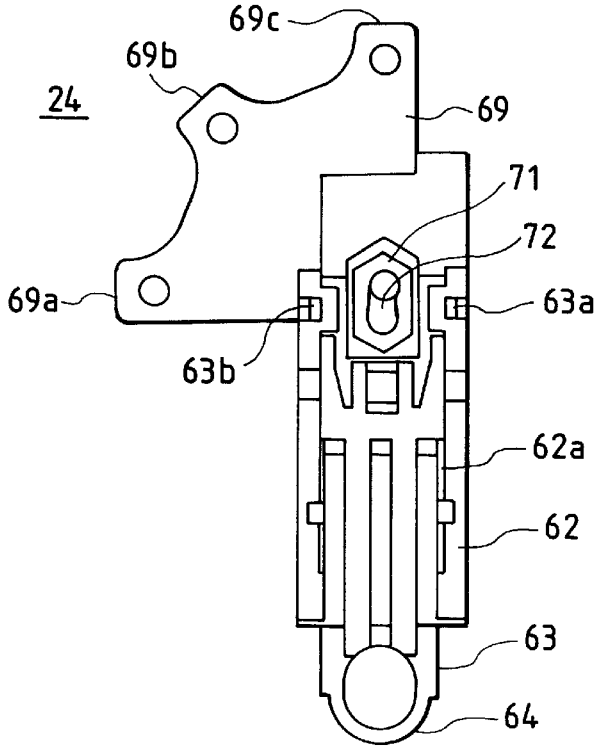
FIG. 7 is a front view showing a paper end detector in the embodiment.
Figure 8:
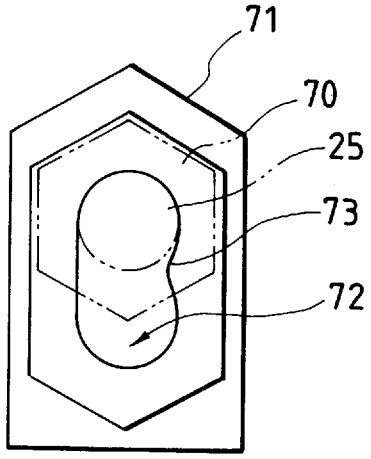
FIG. 8 is an enlarged front view showing the portion where the paper end detector is fixed to the main unit frame in the embodiment.
Figure 9:
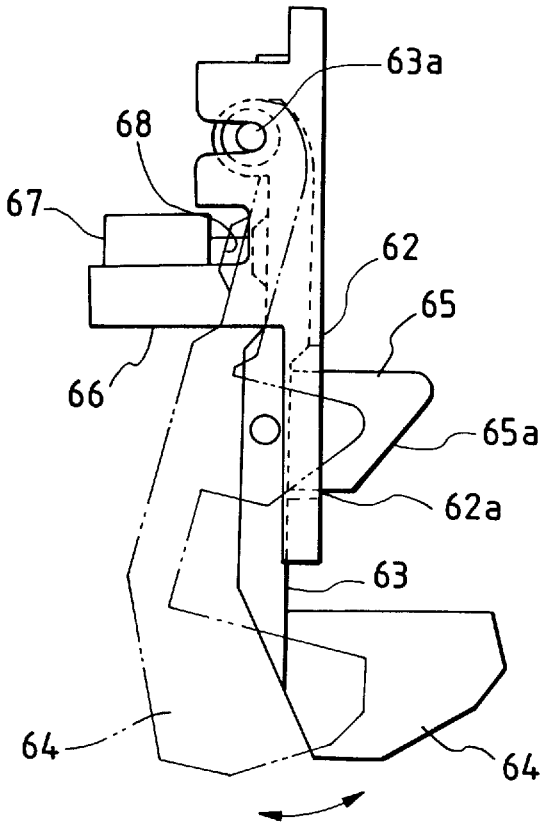
FIG. 9 is a side view showing the paper end detector in the embodiment.

FIGS. 7 to 9 show the paper end detector 24 in the embodiment. FIG. 7 is a front view, FIG. 8 is an enlarged front view of the portion where the detector is fixed to the main unit frame, and FIG. 9 is a side view.

As shown in FIG. 7, the paper end detector 24 in the embodiment is mainly configured by a detection frame 62 and the detection lever 63 which are formed as long members. Both the detection frame 62 and the detection lever 63 are made of a resin material such as acrylonitrile butadiene styrene copolymer (ABS), or polyacetal (POM). Two support shafts 63*a* and 63*b* are symmetrically formed on the basal end portion of the detection lever 63. As shown in FIG. 9, the detection lever 63 is engaged with the detection frame 62 so as to be rotatable about the support shafts 63*a* and 63*b*.

A detecting element 64 which abuts against a side end face of the recording paper S is disposed at the tip end portion of the detection lever 63. The detecting element 64 is made of, for example, a resin material. The detecting element may be integrated with the detection lever 63. The detecting element 64 elongates in a direction perpendicular to the longitudinal direction of the detection lever 63. The detecting element 64 is formed into a tapered shape so as to easily enter a space 76 in a core portion 75 of the recording paper S as described later.

As shown in FIG. 9, a projection 65 which will be described later is formed at a middle portion of the detection lever 63. The projection 65 is configured by, for example, a resin plate-like member, and elongates in a direction perpendicular to the longitudinal direction of the detection lever 63 in the same manner as the detecting element 64. In this case, the projection 65 is slightly shorter than the detecting element 64. The projection 65 may be integral with the detection lever 63.

An inclined face 65*a* is formed on the side of the projection 65 which opposes the detecting element 64, i.e., the outer side in a radial direction of the recording paper S, and the tip end portion of the projection 65 is tapered.

On the other hand, as shown in FIGS. 7 and 9, a window 62*a* through which the projection 65 of the detection lever 63 can escape is formed in the detection frame 62. A support portion 66 is formed at a substantially middle portion of the detection frame 62, and a limit switch 67 is disposed on the support portion 66. When the detection lever 63 is rotated, the limit switch 67 is turned on or off. The embodiment is configured so that the detection lever 63 is pressed against the detection frame 62 by a pressing force of a switch pin 68 due to a spring in the limit switch 67. The limit switch 67 is connected to the junction board (not shown).

As shown in FIG. 7, a grip portion 69 for rotating the paper end detector 24 is united with the end portion in the side of the detection frame 62 where the detection lever 63 is not disposed. The grip portion 69 is configured by forming three projections 69*a* to 69*c* in a plate-like basal portion.

As shown in FIGS. 7 and 8, an oblong hole 72 through which the bolt 25 functioning as a support shaft can pass is formed in the vicinity of the center of curvature of the three projections 69*a* to 69*c*. In the oblong hole 72, furthermore, a bulge portion 73 is formed so that a substantially middle portion of the oblong hole 72 is narrowed.

An annular rib 71 is formed in the periphery of the hole, thereby preventing a nut 70 from rotating.

In the embodiment, the detection frame 62 is made of a resin, and the head of the bolt 25 made of a metal directly contacts with the main unit frame 13. Therefore, the bolt 25 is electrically connected with the main unit frame 13 so that static electricity is prevented from building up in the bolt 25. Accordingly, a breakage due to static electricity does not occur in the limit switch 67 of the paper end detector 24.

Figure 10A:
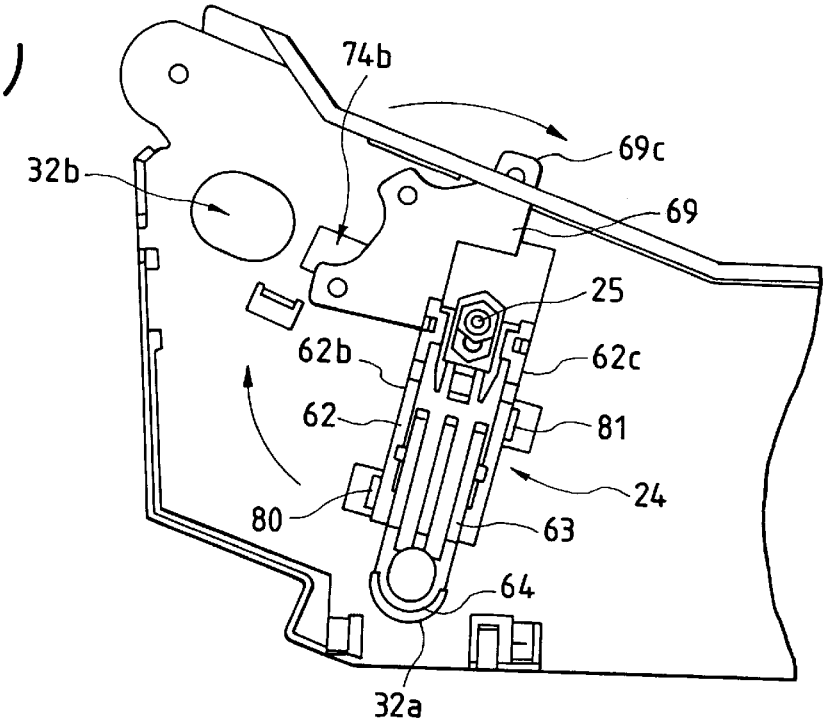
FIGS. 10(*a*) and 10(*b*) show a state where the paper end detector in the embodiment is attached to the main unit frame, more specifically, FIG. 10(*a*) shows the case where the printer is to be installed with downward directing the bottom face and an inclined portion of the main unit frame, and FIG. 10(*b*) shows the case where the printer is to be installed with downward directing the back face of the main unit frame.
Figure 10B:
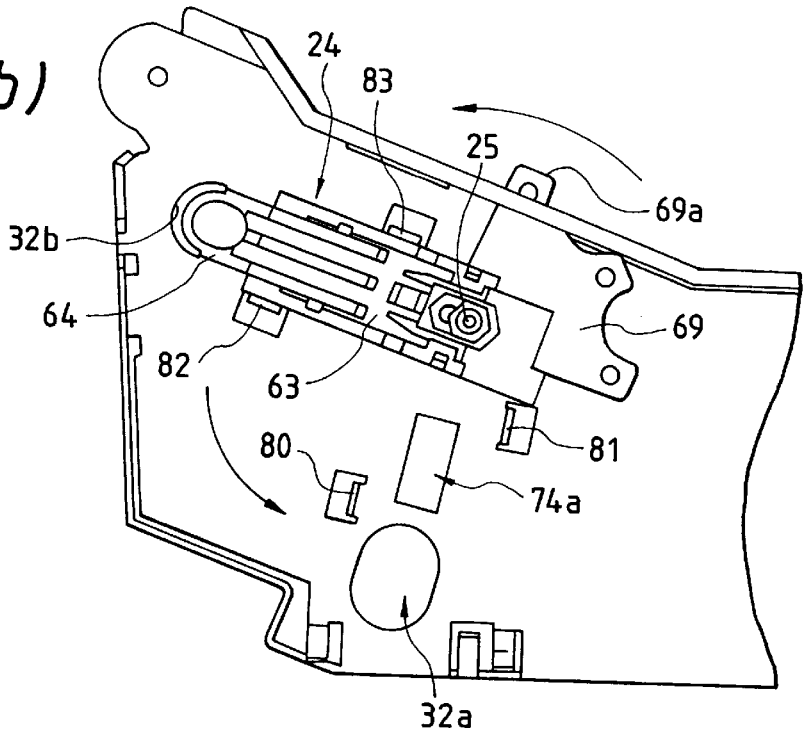

FIGS. 10(*a*) and 10(*b*) show a state where the paper end detector 24 in the embodiment is attached to the main unit frame 13. FIG. 10(*a*) shows the case where the printer 1 is to be installed with downward directing the bottom face 28 and the inclined portion 28*a* of the main unit frame 13, and FIG. 10(*b*) shows the case where the printer 1 is to be installed with downward directing the back face 29 of the main unit frame 13.

As described above, the paper end detector 24 is attached to the main unit frame 13 so as to be rotatable about the bolt 25 serving as the support shaft, and the detecting element 64 of the detection lever 63 enters the hole 32*a* or 32*b* formed in the main unit frame 13. The holes 32*a* and 32*b* are located at positions which are separated from the support shaft by an equal distance. In this case, the holes 32*a* and 32*b* are disposed so as to form an angle of, for example, 90° about the bolt 25 serving as the support shaft.

The holes 32*a* and 32*b* are disposed in the vicinity of the guiding portions of the roll-paper holder 17. Therefore, also the guiding portions 38 and 60 are disposed so as to form an angle of, for example, 90° about the bolt 25 serving as the support shaft. On the other hand, the holes 32*a* and 32*b* are formed into an elliptical shape which elongate in the longitudinal direction of the paper end detector 24. Rectangular holes 74*a* and 74*b* through which the projection 65 of the detection lever 63 can pass are formed in the vicinity of the holes 32*a* and 32*b*, respectively. As shown in FIG. 1, either of the projections 69*a* to 69*c* of the grip portion 69 is inserted into a slit-like guide hole 170 which is formed in the roll-paper holder 17.

As illustrated, raised portions 80 to 83 serving as the engaging portion which engages with the paper end detecting member are formed on the left side face of the main unit frame 13 so as to be directed toward the detecting means. These raised portions abut against both sides 62*b* and 62*c* of the detection frame 62 which are formed in parallel, thereby positioning the paper end detector 24. When the paper end detector 24 is placed between the raised portions 80 and 81, therefore, the detecting element 64 of the detection lever 63 corresponds to the guiding portion 38 in which the recording paper S is held when it has a small diameter.

When the installation angle of the printer 1 is to be changed, the bolt 25 is loosened so as to allow the paper end detector 24 to be rotated, and the projection 69*c* or 69*a* of the grip portion 69 is nipped and then rotated in a clockwise or counterclockwise direction so that the paper end detector is placed between the raised portions 82 and 83. As a result, the detecting element 64 of the detection lever 63 is inserted into the hole 32*b* corresponding to the guiding portion 60 in which the recording paper S is held when it has a small diameter, and the projection 65 is inserted into the hole 74*b*.

Commercially available recording paper has a core having either of two kinds of diameters, i.e., 18 mm or 22 mm. The embodiment can cope with both the kinds of the core of recording paper. When the outer diameter of the core is large, the position of the paper end detector is adjusted with respect to the bolt 25 so that the detecting element 64 of the detection lever 63 is separated from the bottom of the guiding portion, and, when the outer diameter of the core is small, the detecting element is made close to the bottom. In the embodiment, the oblong hole 72 which is used for the adjustment and through which the bolt 25 passes is formed, and the bulge portion 73 is formed in the oblong hole 72 so that the substantially middle portion of the hole is narrowed. Therefore, the detection lever 63 can be moved to an optimum position with checking the movement by means of 1 clicking feeling.

Figure 11A:
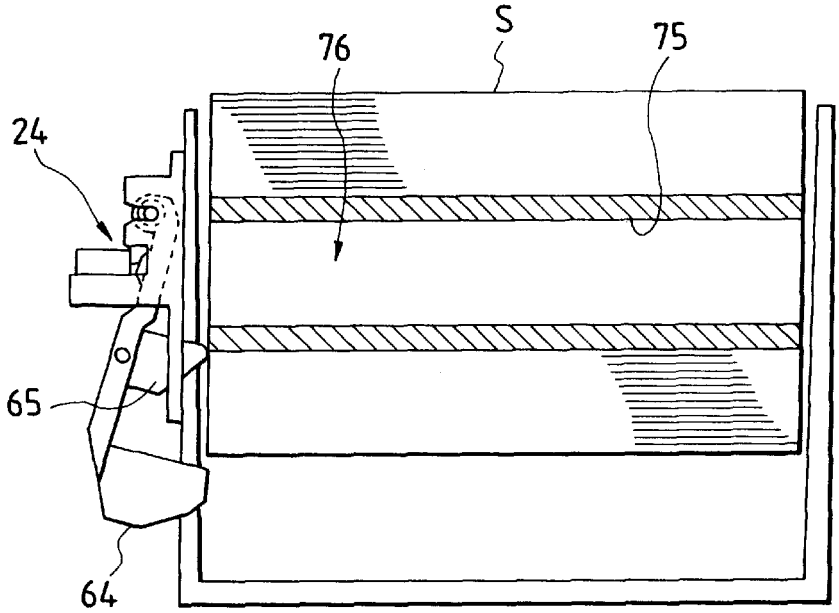
FIGS. 11(*a*) and 11(*b*) are diagrams showing the operation of the paper end detector in the embodiment, more specifically, FIG. 11(*a*) shows the case where the paper end detector is in the off state, and FIG. 11(*b*) shows the case where the paper end detector is in the on state.
Figure 11B:
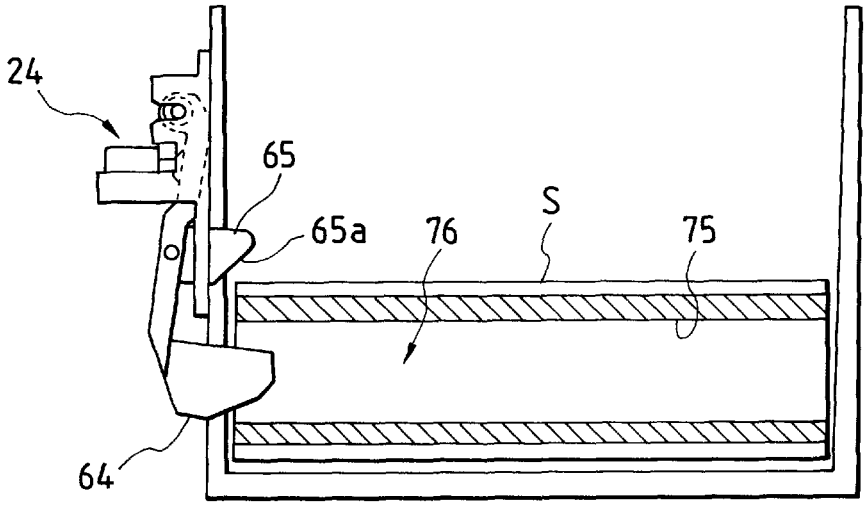

FIGS. 11(*a*) and 11(*b*) show the operation of the paper end detector 24 in the embodiment. FIG. 11(*a*) shows the case where the paper end detector 24 is in the off state, and FIG. 11(*b*) shows the case where the paper end detector 24 is in the on state.

As shown in FIG. 11(*a*), when a large amount of the recording paper S remains, the detecting element 64 or the projection 65 of the detection lever 63 abuts against the side face of the recording paper S. Therefore, the detection lever 63 is pressed backward and the limit switch 67 is kept to be in the off state.

In a line thermal printer as in the case of the embodiment, unlike in a serial dot printer, the recording paper S is not intermittently fed. This produces a problem in that, when the recording paper is slacked by pulling-up the recording paper so as to be deviated in the width direction from the rolled recording paper S, the deviation cannot be corrected. In order to solve this problem, the positions and angles of the supporting faces 17*a*, 17*c*, 17*d*, and 17*e* of the roll-paper holder 17 are improved so that the recording paper S can slightly swing. This will be described in more detail. The recording paper S is easily positioned on the guiding portion 38. When the recording paper S is once fed, however, the recording paper is moved over the supporting face 17*c* of a gentle inclination, and then returned to the guiding portion 38 by the supporting face 17*a* formed by a steep angle. In this way, when the diameter of the recording paper S is large, the recording paper is pulled out while being intermittently swung. In the case where the diameter of the recording paper S becomes small, the recording paper hardly escapes from the guiding portion 38, and, even when it is deviated in the width direction, the deviation can be easily corrected because the recording paper is light in weight.

In the case where the recording paper S has a medium diameter, there arises a problem in that, when the recording paper S is moved and its outer periphery abuts against the supporting face 17*a* formed by a steep angle, the detecting element 64 of the detection lever 63 is separated from the side face of the recording paper S and the limit switch 67 erroneously operates. According to the embodiment, even when the recording paper S swings, however, either of the detecting element 64 and the projection 65 of the detection level 63 abuts against the side face of the recording paper S as shown in FIG. 11(*a*), and hence the detection lever 63 is always backward pressed, with the result that the limit switch 67 is kept to be in the off state.

In the case where the recording paper S has a very small remaining amount, as shown in FIG. 11(*b*), the recording paper S is moved and the detecting element 64 of the detection lever 63 enters the space 76 in a core portion 75, with the result that the limit switch 67 is set to be the off state. A signal indicative of the above is coupled to a main circuit board (not shown) which is connected by an FFC or the like and controls the printer.

As described above, in the printer 1 of the embodiment, the plural guiding portions 38 and 60 for stabilizing the recording paper S in which the remaining amount is reduced to a fixed level or less are disposed, and the position of the paper end detector 24 can be moved to the vicinity of the guiding portion 38 or 60 in accordance with the installation angle of the printer 1. Even when the installation angle of the printer 1 is changed, therefore, the positional relationship between the core portion 75 of the recording paper S in which the remaining amount is reduced to a fixed level or less, and the paper end detector 24 can be correctly kept constant, thereby enabling the end of the recording paper S to be correctly detected irrespective of the installation position. Furthermore, it is not required to dispose plural paper end detecting means, and hence the structure is not complicated.

In the embodiment, the paper end detector 24 can be positioned so as to be oriented in either of directions perpendicular to each other. Consequently, the end of the rolled recording paper S can be always correctly detected not only in the case where the printer 1 is installed on a horizontal table but also in another case such as that where the printer is installed on a vertical wall.

The paper end detector 24 is rotatably fixed to the main unit frame 13 by the bolt 25 and the nut 70, and the position of the paper end detector 24 can be changed by loosening the bolt and the nut and rotating the detector. Therefore, the paper end detector 24 can be moved very easily to the vicinity of the guiding portion 38 or 60 of the printer 1 without changing the relative positional relationship between the paper end detector 24 and the core portion 75 of the recording paper S. Accordingly, the work of installing the printer 1 can be easily conducted.

Since the detection lever 63 is provided with the projection 65 opposing the recording paper S, the paper end detector 24 can be always kept to be in the off state even when the recording paper S swings. Consequently, it is possible to prevent the paper end from being erroneously detected.

In the embodiment, the inclined face 65*a* is formed on the side of the projection 65. When the paper end detector 24 is to be moved, therefore, the projection is moved toward the outside of the recording paper housing unit by the edge of the hole 74*a* or 74*b* of the main unit frame 13 and is not caught by the frame, thereby allowing the near-end detector 24 to be easily moved. As a result, the work of installing the printer 1 can be easily conducted.

In the embodiment, the supporting portion 61 constituting the guiding portion 60 is configured separately from the roll-paper holder 17. In the production process of the main unit frame 13, therefore, a punching operation can be easily conducted, so that the production process can be simplified.

The invention is not restricted to the embodiment described above, and may be modified in various manners.

In the embodiment, two guiding portions are disposed. Alternatively, three or more guiding portions may be disposed and the paper end detecting means may be positioned in accordance with the positions of the guiding portions.

In the embodiment, the paper end detecting means is positioned so as to be oriented in either of directions perpendicular to each other. The invention is not restricted to this. The paper end detecting means may be positioned at either of various angles in accordance with the installation angle of the printer.

The paper end detecting means is not restricted to that using a limit switch. For example, means for optically detecting the end of the recording paper may be used. When a limit switch is used as described in the embodiment, however, there is an advantage that the paper end can be detected easily and surely.

The supporting portion-constituting the guiding portion disposed in the rear portion of the main unit frame may be integrated with the upper cover. In the configuration where a separately formed supporting portion is fixed to a roll-paper holder as the embodiment, however, the assembly accuracy of the guiding portion can be improved.

In the above, an embodiment in which raised portions are formed on a main unit frame and a paper end detector is positioned between the raised portions has been described. Alternatively, only one raised portion may be used, or another configuration may be employed in which a projection is formed on one of a main unit frame and a detection frame, a hole is formed in the other frame, and engagement is established between them.

As seen from the above description, even when the installation angle of the printer is changed, the positional relationship between the core portion of the recording paper and the detecting element of the paper end detecting means is always kept constant by setting the guiding portions to the angle, and hence the detected remaining amount is not changed. Since the paper end detecting means is required only to be rotated, the change operation can be conducted very easily.

Furthermore, the end user can easily change the detection position without using a jig. Consequently, the posture of the printer can be easily changed in accordance with its use, so that workability is extremely improved.

What is claimed is:

1. A printer for printing on paper dispensed from a roll of recording paper, the printer comprising:

a paper guide which selectively guides the roll of recording paper to one of first and second predetermined positions in accordance with a mounting orientation of the printer; and a sensor, provided rotatably relative to the paper guide such that the sensor can be selectively positioned at one of a plurality of detection positions each corresponding to one of the first and second predetermined positions of the roll of recording paper, for detecting a remaining amount of the roll of recording paper in comparison with a predetermined amount when the sensor is in one of the detection positions.

2. The printer according to claim 1, further comprising a housing unit which houses the roll of recording paper, the housing unit having an engaging portion which engages with the sensor to locate the sensor at the detection position.

3. The printer according to claim 2, wherein the sensor comprises:

a shaft portion;

a detection frame which is rotatably attached to at least one side face of the housing unit through the shaft portion;

a detecting lever which has the detecting element and which is movably attached to the detection frame; and means for manually rotating the detection frame.

4. The printer according to claim 3, wherein the means for manually rotating the detection frame comprises a plurality of projections integral with the detection frame, wherein the distances between the projections and the shaft portion are substantially equal to each other.

5. The printer according to claim 3, wherein the detection frame has an oblong hole through which the shaft portion passes, the oblong hole having a narrow portion at a middle portion, the narrow portion having a width smaller than an outer diameter of the shaft portion.

6. The printer according to claim 1, wherein the sensor has a detecting element for detecting that the remaining amount of the roll of recording paper is reduced to a predetermined level or less when the detecting element enters a space in a core portion of the roll of recording paper.

* * * * *